US006341378B1

(12) United States Patent
Pietsch et al.

(10) Patent No.: US 6,341,378 B1
(45) Date of Patent: Jan. 29, 2002

(54) RAINCOAT

(76) Inventors: Frank L. Pietsch, 4614 NE. 54th St., Vancouver, WA (US) 98661; Richard L. Getty, 2310 NE. 57th St., Vancouver, WA (US) 98663

( * ) Notice: Subject to any disclaimer, the term of this patent is extended or adjusted under 35 U.S.C. 154(b) by 0 days.

(21) Appl. No.: 09/586,025

(22) Filed: Jun. 2, 2000

(51) Int. Cl.[7] ..... A41D 3/04
(52) U.S. Cl. ..... 2/87; 2/85; 441/102
(58) Field of Search ..... 2/87, 456, 69, 2/69.5, 84, 85, 108, 93, 88, 912, 2.15; 441/87, 88, 102, 103, 104, 129–133

(56) References Cited

U.S. PATENT DOCUMENTS

| | | | | | |
|---|---|---|---|---|---|
| 1,802,807 | A | | 4/1931 | Davis | |
| 3,843,983 | A | | 10/1974 | Tangen | |
| 4,079,466 | A | * | 3/1978 | Rosenstein | 2/87 |
| 4,227,264 | A | * | 10/1980 | Spector et al. | 2/84 |
| D294,535 | S | | 3/1988 | Stricklin | |
| 4,799,910 | A | | 1/1989 | Kellough | |
| 5,056,160 | A | * | 10/1991 | Buchanan | 2/88 |
| 5,101,513 | A | * | 4/1992 | Bowers | 2/84 |
| 5,168,579 | A | | 12/1992 | Marshall | |
| 5,511,507 | A | * | 4/1996 | Allen | 114/347 |
| 5,643,031 | A | | 7/1997 | Fenton et al. | |
| 6,227,923 | B1 | * | 5/2001 | Johnson | 441/61 |

* cited by examiner

*Primary Examiner*—John J. Calvert
*Assistant Examiner*—Tejash Patel

(57) ABSTRACT

A raincoat for fitting over the outside surface of a floating fishing device. The raincoat includes a garment. The garment comprises a torso portion, and two arm portions integrally coupled to the torso portion. The garment has a neck opening therein. The garment has a skirt portion integrally coupled to and extending away from the torso portion. The skirt portion has a circumference at least one and half times the circumference of the torso portion. The garment comprising a substantially water impermeable material. The skirt portion may be placed over the outside surface of a fishing floatation device.

20 Claims, 3 Drawing Sheets

RAINCOAT

BACKGROUND OF THE INVENTION

1. Field of the Invention

The present invention relates to raincoats and more particularly pertains to a new raincoat for fitting over the outside surface of a floating fishing device.

2. Description of the Prior Art

The use of raincoats is known in the prior art. More specifically, raincoats heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,802,807; U.S. Pat. No. 5,168,579; U.S. Des. Pat. No. 294,535; U.S. Pat. No. 4,799,910; U.S. Pat. No. 3,843,983; and U.S. Pat. No. 5,643,031.

While these devices fulfill their respective, particular objectives and requirements, the aforementioned patents do not disclose a new raincoat. The inventive device includes a garment. The garment comprises a torso portion, and two arm portions integrally coupled to the torso portion. The garment has a neck opening therein. The garment has a skirt portion integrally coupled to and extending away from the torso portion. The skirt portion has a circumference at least one and half times the circumference of the torso portion. The garment comprising a substantially water impermeable material. The skirt portion may be placed over the outside surface of a fishing floatation device.

In these respects, the raincoat according to the present invention substantially departs from the conventional concepts and designs of the prior art, and in so doing provides an apparatus primarily developed for the purpose of fitting over the outside surface of a floating fishing device.

SUMMARY OF THE INVENTION

In view of the foregoing disadvantages inherent in the known types of raincoats now present in the prior art, the present invention provides a new raincoat construction wherein the same can be utilized for fitting over the outside surface of a floating fishing device.

The general purpose of the present invention, which will be described subsequently in greater detail, is to provide a new raincoat apparatus and method which has many of the advantages of the raincoats mentioned heretofore and many novel features that result in a new raincoat which is not anticipated, rendered obvious, suggested, or even implied by any of the prior art raincoats, either alone or in any combination thereof.

To attain this, the present invention generally comprises a garment. The garment comprises a torso portion, and two arm portions integrally coupled to the torso portion. The garment has a neck opening therein. The garment has a skirt portion integrally coupled to and extending away from the torso portion. The skirt portion has a circumference at least one and half times the circumference of the torso portion. The garment comprising a substantially water impermeable material. The skirt portion may be placed over the outside surface of a fishing floatation device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new raincoat apparatus and method which has many of the advantages of the raincoats mentioned heretofore and many novel features that result in a new raincoat which is not anticipated, rendered obvious, suggested, or even implied by any of the prior art raincoats, either alone or in any combination thereof.

It is another object of the present invention to provide a new raincoat which may be easily and efficiently manufactured and marketed.

It is a further object of the present invention to provide a new raincoat which is of a durable and reliable construction.

An even further object of the present invention is to provide a new raincoat which is susceptible of a low cost of manufacture with regard to both materials and labor, and which accordingly is then susceptible of low prices of sale to the consuming public, thereby making such raincoat economically available to the buying public.

Still yet another object of the present invention is to provide a new raincoat which provides in the apparatuses and methods of the prior art some of the advantages thereof, while simultaneously overcoming some of the disadvantages normally associated therewith.

Still another object of the present invention is to provide a new raincoat for fitting over the outside surface of a floating fishing device.

Yet another object of the present invention is to provide a new raincoat which includes a garment. The garment comprises a torso portion and two arm portions integrally coupled to the torso portion. The garment has a neck opening therein. The garment has a skirt portion integrally coupled to and extending away from the torso portion. The skirt portion has a circumference at least one and half times the circumference of the torso portion. The garment comprising a substantially water impermeable material. The skirt portion may be placed over the outside surface of a fishing floatation device.

Still yet another object of the present invention is to provide a new raincoat that that can be used as a standard raincoat but which also prevents water from entering a tube-type floatation device used for fishing.

Even still another object of the present invention is to provide a new raincoat that has openings therein for access to compartments in the floatation device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
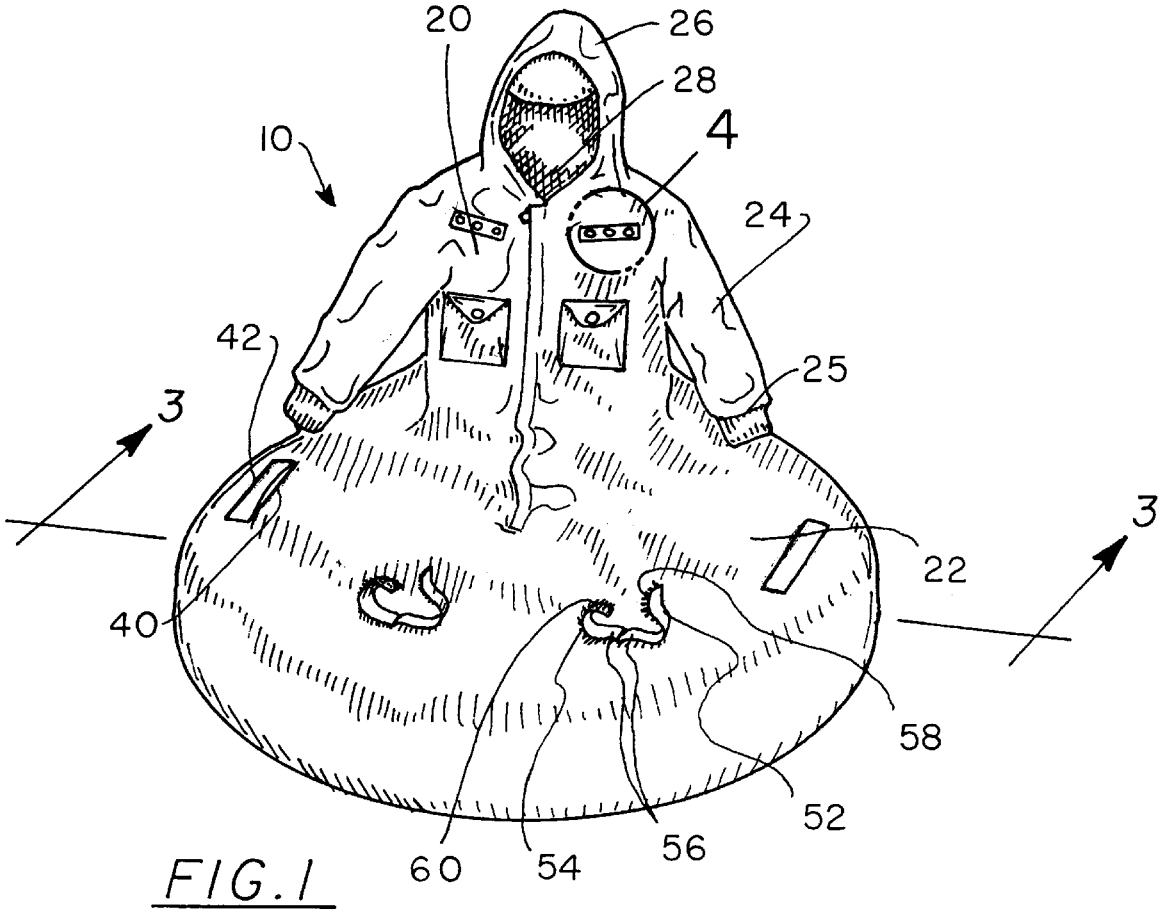
FIG. 1 is a schematic perspective view of a new raincoat according to the present invention.

With reference now to the drawings, and in particular to FIGS. 1 through 4 thereof, a new raincoat embodying the principles and concepts of the present invention and generally designated by the reference numeral 10 will be described.

As best illustrated in FIGS. 1 through 4, the raincoat 10 is made for a person using a conventional floating fishing device 12. The typical floating fishing device generally comprises an inner-tube 14 having compartments 16 therein and a pair of waders 18 integrally coupled to the inner-tube 14. Other embodiments incorporate a chair suspended across the inner-tube for seating of the user.

The raincoat comprises a garment having a torso portion 20 and a skirt portion 22 integrally coupled together. Two arm portions 24 are integrally coupled to the torso portion 20, and a hood portion 26 is also preferably integrally coupled to the torso portion 20. Each of the arm portions 24 has a free end 25. The garment has a neck opening 28 therein. The skirt portion 22 has a circumference substantially equal to a circumference of the floating fisting device 12 which is preferably at least one and half times greater than the circumference of the torso portion 20. The skirt portion 22 has a bottom edge 30. The garment comprises a substantially water impermeable material such as plastic or an elastomeric material.

The garment has an elongate slit 32. The elongate slit 32 is generally positioned in a chest portion of the torso portion 20. The elongate slit 32 extends from the skirt portion 22 to and through the neck opening 28. A closing means selectively closes the elongate slit 32. The closing means comprises a zipper but may be a hook and loop fastening means. The garment has a plurality of apertures 34 therein. The apertures 34 are positioned in the chest portion. The apertures 34 allow for breathing of the garment to cool down the user. A plurality of panels 36 covers the apertures 34. Each of the panels 36 has an edge fixedly coupled to the garment and each is positioned to cover one of the apertures 34. A plurality of coupling means 38 removably couples the panels 36 in a closed position over the apertures 34. The coupling means 38 preferably comprises a plurality of buttons. The panels 36 may be placed in an open position to allow air to enter the apertures.

The skirt 22 has a plurality of openings 40 therein. The openings 40 are positioned to allow access to the compartments 16 in the floating fishing device 12. Each of the openings 40 has a flap 42 for selectively covering the openings 40.

A visor member 44 is preferably coupled to and extends away from the hood portion 26. The visor member 44 is positioned generally adjacent to a top part of the hood portion 26 and ideally comprises a resiliently flexible material.

Each of a pair of cuff members 46 is fixedly coupled to one of the free ends 25 of the arm portions 24. Each of the cuff members 46 comprises an elastic material.

Figure 2:
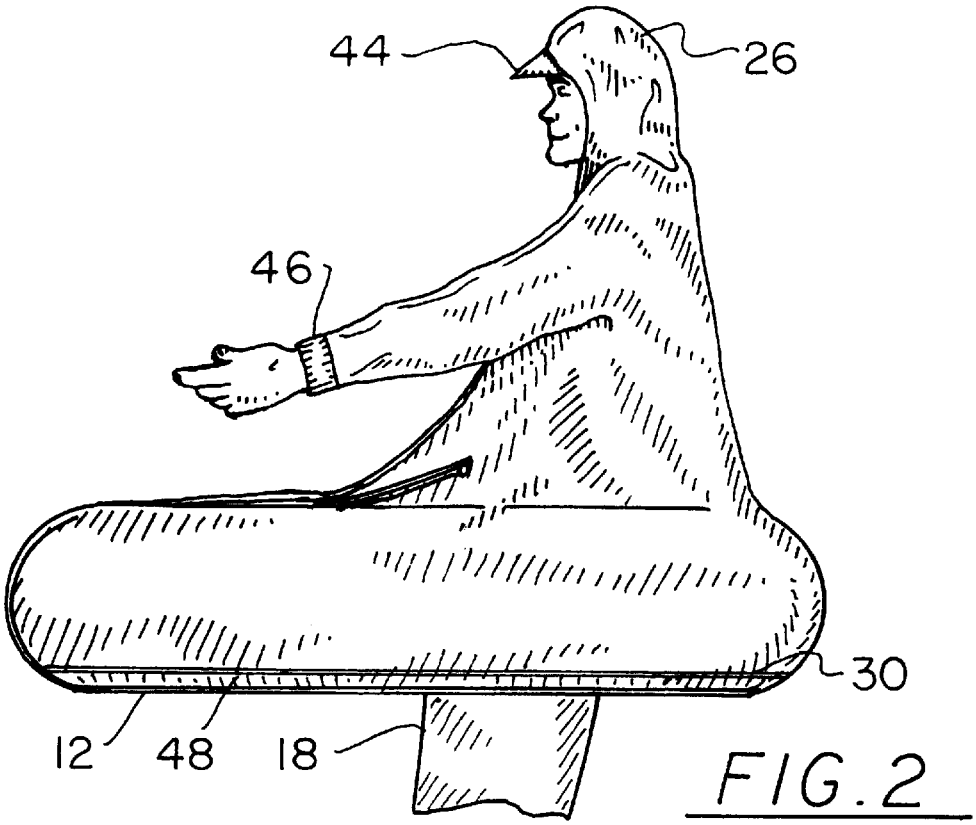
FIG. 2 is a schematic side view of the present invention.
Figure 3:
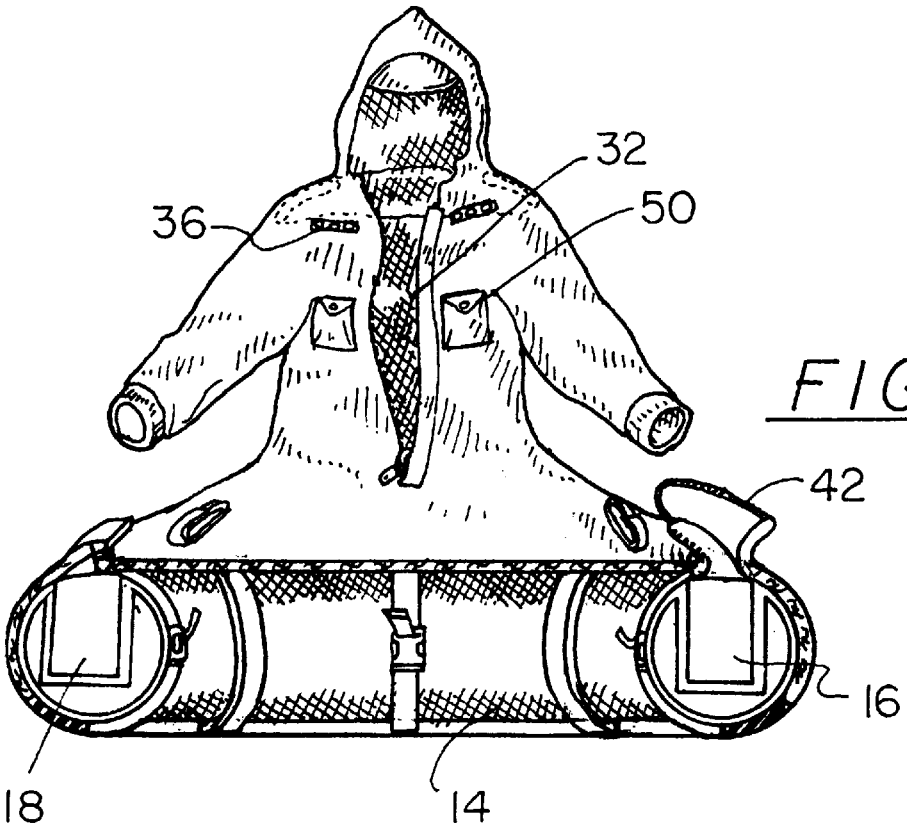
FIG. 3 is a schematic front cross-sectional view of the present invention.
Figure 4:
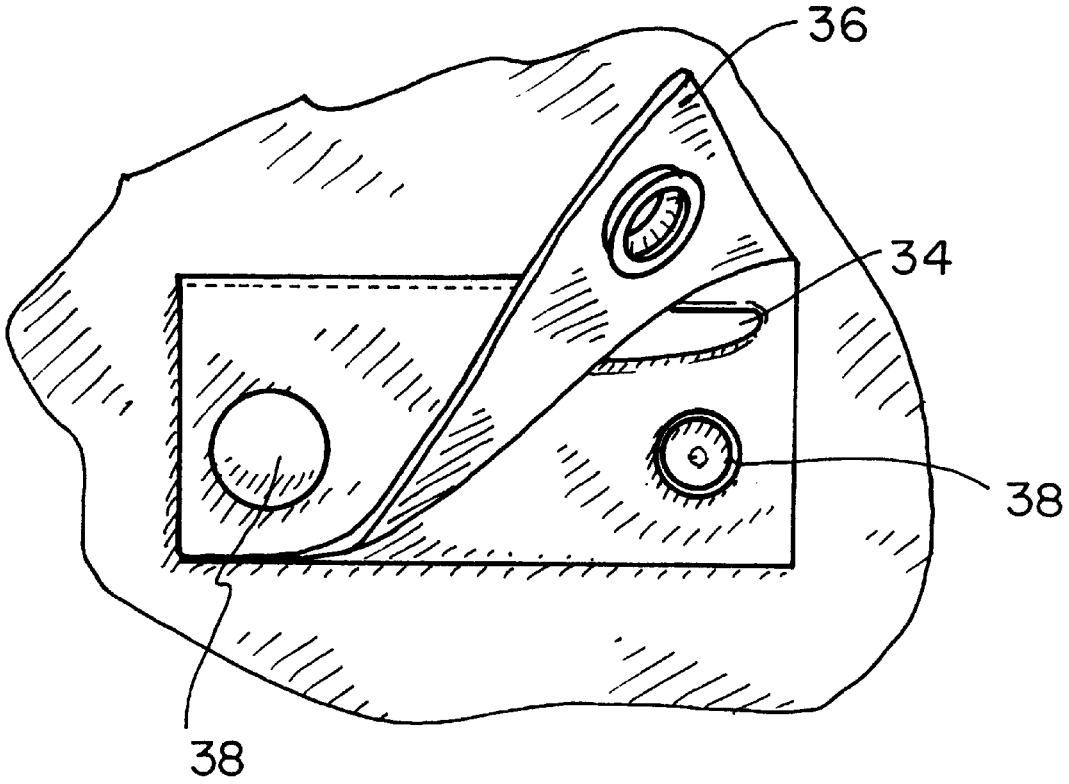
FIG. 4 is a schematic exploded view of the aperture and a corresponding panel of the present invention.

A securing means removably secures the skirt portion 22 to an outside surface of the floating fishing device 12. The securing means comprises an elastic band 48. The elastic band 48 is fixedly coupled to the skirt 22 and is positioned generally adjacent to the bottom edge 30 of the skirt 22. The skirt 22 is placed over the floating fishing device 12 as depicted in FIGS. 1 and 2 such that a seal is substantially made between the elastic band 48 and the floating fishing device 12 and the skirt 22 remains around the floating fishing device. The securing means may not be needed if materials are used which create a large enough coefficient of friction between the skirt 22 and the device 12.

Each of a plurality of pockets 50 is coupled to the chest portion of the garment.

A fastening means removably fastens articles, such as fishing poles, to the skirt 22. The fastening means comprises at least one pair of elongate members 52, 54. Each of the elongate members 52, 54 is substantially flexible. Each of the elongate members has a first end 56 fixedly coupled to the skirt 22 such that the elongate members are substantially adjacent to each other. A hook portion 58 of a hook and loop fastening means is fixedly coupled to a first 52 of the elongate members and a loop portion 60 is fixedly coupled to a second 54 of the elongate members. Wherein, the first 52 and second 54 elongate members may be releasably fastened to each other.

In use, the user places the raincoat 10 on their body and steps into the floating fishing device. The skirt 22 is then placed around the floatation device 12 so that rain may not enter the floatation device 12. The skirt 22 is positioned such that the openings 40 in the skirt 22 correspond with any compartments 18 in the device. The apertures 34 and elongate slit 32 may be used to cool down a wearer of the raincoat and the elongate slit 32 also aids in removing and putting on the raincoat 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A raincoat, said raincoat being removably coupled to a floating fishing device, the floating fishing device generally comprising an inner-tube having compartments therein and having a pair of waders integrally coupled thereto, said raincoat comprising:

a garment, said garment comprising a torso portion, and two arm portions integrally coupled to said torso portion, said garment having a neck opening therein, said garment having a skirt portion integrally coupled to and extending away from said torso portion, said skirt portion having a circumference at least one and half times the circumference of the torso portion, said skirt portion having a bottom edge, said garment comprising a substantially water impermeable material; and a securing means being attached to said skirt portion for removably securing said skirt portion to an outside surface of said floating fishing device, said securing means comprising an elastic band, said elastic band being fixedly coupled to said skirt and positioned generally adjacent to said bottom edge of said skirt, wherein said skirt is positionable over said floating fishing device such that a seal is substantially made between said elastic band and said floating fishing device.

2. The raincoat as in claim 1, said garment further comprising a hood portion integrally coupled to said torso portion.

3. The raincoat as in claim 1, wherein said skirt portion further comprises:

said skirt portion having a circumference substantially equal to a circumference of said floating fisting device.

4. The raincoat as in claim 1, further comprising:

a visor member being coupled to and extending away from said hood portion, said visor member being positioned generally adjacent to a top part of said hood portion.

5. The raincoat as in claim 1, further comprising:

each of said arm portions having a free end; and a pair of cuff members, each of said cuff members being fixedly coupled to one of said free ends of said arm portions, each of said cuff members comprising an elastic material.

6. The raincoat as in claim 1, wherein said garment further comprises:

said garment having an elongate slit therein, said elongate slit being generally positioned in a chest portion of said torso portion, said elongate slit extending from said skirt portion to said neck opening, a closing means selectively closes said elongate slit.

7. The raincoat as in claim 6, further comprising:

a plurality of pockets, each of said pockets being coupled to said chest portion of said garment.

8. The raincoat as in claim 1, further comprising:

said garment having a plurality of apertures therein, said apertures being positioned in said chest portion; and a plurality of panels for covering said apertures, each of said panels each having an edge fixedly coupled to said garment and positioned to cover one of the apertures, a plurality of coupling means removably couples said panels in a closed position.

9. The raincoat as in claim 1, wherein said garment further comprises:

said skirt having a plurality of openings therein, said openings being positioned to allow access to the compartments in the floating fishing device, each of said openings having a flap for selectively covering said openings.

10. The raincoat as in claim 1, further comprising a fastening means for removably fastening articles to said skirt.

11. The raincoat as in claim 10, where in said fastening means comprises:

at least one pair of elongate members, each of said elongate members being substantially flexible, each of said elongate members having a first end fixedly coupled to said skirt such that said elongate members are substantially adjacent to each other, a hook portion of a hook and loop fastening means being fixedly coupled to a first of the elongate members and a loop portion being fixedly coupled to a second of the elongate members, wherein said first and second elongate members may be releasably fastened to each other.

12. A raincoat, said raincoat being removably coupled to a floating fishing device, the floating fishing device generally comprising an inner-tube having compartments therein and having a pair of waders integrally coupled thereto, said raincoat comprising:

a garment, said garment comprising a torso portion, two arm portions integrally coupled to said torso portion, and a hood portion integrally coupled to said torso portion, each of said arm portions having a free end, said garment having a neck opening therein, said garment having a skirt portion integrally coupled to and extending away from said torso portion, said skirt portion having a circumference substantially equal to a circumference of said floating fisting device, said skirt portion having a bottom edge, said garment comprising a substantially water impermeable material, said garment having an elongate slit, said elongate slit being generally positioned in a chest portion of said torso portion, said elongate slit extending from said skirt portion to said neck opening, a closing means selectively closes said elongate slit, said closing means comprising a zipper, said garment having a plurality of apertures therein, said apertures being positioned in said chest portion, said skirt having a plurality of openings therein, said openings being positioned to allow access to the compartments in the floating fishing device, each of said openings having a flap for selectively covering said openings;

a plurality of panels for covering said apertures, each of said panels each having an edge fixedly coupled to said garment and positioned to cover one of the apertures, a plurality of coupling means removably couples said panels in a closed position, said coupling means comprising buttons, wherein said panels may be placed in an open position to allow air to enter said apertures;

a visor member being coupled to and extending away from said hood portion, said visor member being positioned generally adjacent to a top part of said hood portion;

a pair of cuff members, each of said cuff members being fixedly coupled to one of said free ends of said arm portions, each of said cuff members comprising an elastic material;

a securing means for removably securing said skirt portion to an outside surface of said floating fishing device, said securing means comprising an elastic band, said elastic band being fixedly coupled to said skirt and positioned generally adjacent to said bottom edge of said skirt, wherein said skirt is placed over said floating fishing device such that a seal is substantially made between said elastic band and said floating fishing device;

a plurality of pockets, each of said pockets being coupled to said chest portion of said garment; and a fastening means for removably fastening articles to said skirt, said fastening means comprising at least one pair of elongate members, each of said elongate members being substantially flexible, each of said elongate members having a first end fixedly coupled to said skirt such that said elongate members are substantially adjacent to each other, a hook portion of a hook and loop fastening means being fixedly coupled to a first of the elongate members and a loop portion being fixedly coupled to a second of the elongate members, wherein said first and second elongate members may be releasably fastened to each other.

13. A raincoat and floating fishing device combination, said combination comprising:

an inner-tube having compartments therein and having a pair of waders integrally coupled thereto;

a garment, said garment comprising a torso portion, and two arm portions integrally coupled to said torso portion, said garment having a neck opening therein, said garment having a skirt portion integrally coupled to and extending away from said torso portion, said skirt portion having a circumference at least one and half times the circumference of the torso portion, said skirt portion having a bottom edge, said garment comprising a substantially water impermeable material; and a securing means being attached to said skirt portion for removably securing said skirt portion to an outside surface of said floating fishing device, said securing means comprising an elastic band, said elastic band being fixedly coupled to said skirt and positioned generally adjacent to said bottom edge of said skirt, wherein said skirt is placed over said floating fishing device such that a seal is substantially made between said elastic band and said floating fishing device.

14. The raincoat as in claim 13, said garment further comprising a hood portion integrally coupled to said torso portion.

15. The raincoat as in claim 13, wherein said skirt portion has a circumference substantially equal to a circumference of said floating fisting device.

16. The raincoat as in claim 13, further including a visor member being coupled to and extending away from said hood portion, said visor member being positioned generally adjacent to a top part of said hood portion.

17. The raincoat as in claim 13, further comprising:

each of said arm portions having a free end; and a pair of cuff members, each of said cuff members being fixedly coupled to one of said free ends of said arm portions, each of said cuff members comprising an elastic material.

18. The raincoat as in claim 13, wherein said garment has an elongate slit therein, said elongate slit being generally positioned in a chest portion of said torso portion, said elongate slit extending from said skirt portion to said neck opening, a closing means selectively closes said elongate slit.

19. The raincoat as in claim 18, further comprising a plurality of pockets, each of said pockets being coupled to said chest portion of said garment.

20. The raincoat as in claim 13, wherein said skirt has a plurality of openings therein, said openings being positioned to allow access to the compartments in the floating fishing device, each of said openings having a flap for selectively covering said openings.

* * * * *